US005890483A

United States Patent [19]

Stevenson et al.

[11] Patent Number: 5,890,483

[45] Date of Patent: Apr. 6, 1999

[54] HEATERS

[76] Inventors: John Stevenson; Lindy Pamela Caroline Watt, both of September Cottage, Plummers Plain, Horsham, West Sussex, Great Britain, RH13 6NZ

[21] Appl. No.: 897,487

[22] Filed: Jul. 21, 1997

[30] Foreign Application Priority Data

Aug. 6, 1996 [GB] United Kingdom ..... 9616541

[51] Int. Cl.[6] ..... F24C 3/00

[52] U.S. Cl. ..... 126/85 R; 126/90 R; 126/92 AC

[58] Field of Search ..... 126/91 R, 91 A, 126/92 R, 92 AC, 92 A, 90 R, 512, 515, 89, 400, 4; 431/326–329

[56] References Cited

U.S. PATENT DOCUMENTS

| | | | |
|---|---|---|---|
| 756,721 | 4/1904 | Silverberg | 126/87 |
| 963,266 | 7/1910 | Bauer | 126/90 R |
| 1,475,450 | 11/1923 | Schneider | 128/88 |
| 3,582,250 | 6/1971 | Chatfield | 126/512 |
| 4,306,537 | 12/1981 | Mitchell | 126/92 AC |

*Primary Examiner*—James C. Yeung
*Attorney, Agent, or Firm*—Kinney & Lange, P.A.

[57] ABSTRACT

A heater comprises a combustion tube connected to receive gaseous fuel or liquid fuel dispersed within a gaseous carrier gas from a source. The combustion tube communicates with an expansion chamber whose surface is provided with a plurality of openings. The expansion chamber is housed within a perforated container, the internal surface of which is spaced from the external surface of the expansion chamber to receive heating blocks.

15 Claims, 3 Drawing Sheets

HEATERS

BACKGROUND OF THE INVENTION

This invention relates to heaters and more especially, but not exclusively, to heaters of the type traditionally known as braziers and used mainly out of doors for heating and cooking purposes.

In a traditional brazier, charcoal or other solid fuel is burnt in an open topped, cylindrical metal basket or drum and heat is dispersed by radiation and convection from the burning fuel. Characteristics of braziers include a large heat dispersement surface and an appealing visual effect.

Disadvantages include the unwelcome smoke and fumes created as the brazier burns and the time taken to light the brazier and to extinguish it after use.

Gas cooking devices for use outdoors which include a gas burner which heats an internally mounted cooking container are known. Such a device is disclosed in U.S. Pat. No. 5,513,623. Also, an oil burning heater including a chamber bounded by a heat emitting wall with a grate which divides the chamber into an upper zone and a lower combustion space is known from Great Britain Pat. No. 527,388. Neither of these documents discloses the important features of this invention.

The present invention sets out to provide a heater which retains the advantageous characteristics of a brazier but which does not suffer from or at least alleviates the disadvantages referred to above.

BRIEF SUMMARY OF INVENTION

According to the present invention in one aspect there is provided a heater which comprises a combustion tube connected to receive gaseous fuel or liquid fuel dispersed within a gaseous carrier gas from a source of such fuel, an expansion chamber in communication with the combustion tube in whose surface is provided a plurality of openings, and an outer perforated container in which the expansion chamber is housed, the internal surface of the perforated container being spaced from the external surface of the expansion tube to receive heating blocks.

The expansion chamber is preferably positioned about the circumference of the combustion tube. Preferably, the combustion chamber is also housed within the perforated container.

The heating blocks may comprise pieces of lava rock or stone.

In another aspect, the present invention provides a heater which comprises a perforated container which houses an open-ended tubular combustion chamber positioned within an expansion chamber whose ends are closed other than to receive the combustion chamber and whose sides are perforated, means to convey a gaseous fuel or liquid fuel dispersed in a gaseous carrier to one open end of the combustion chamber and for igniting the same, the side walls of the expansion chamber being spaced from the side walls of the container for receiving a heat retaining medium, eg lava pieces.

The perforated container may comprise a cylindrical metal drum whose sides are formed from metal wire. Alternatively, the perforated container may be produced from a metal mesh. The expansion chamber and/or the combustion chamber may be produced from steel, especially stainless steel.

The invention will now be described by way of example only with reference to the accompanying diagrammatic drawings.

BRIEF DESCRIPTION OF INVENTION

DETAILED DESCRIPTION OF INVENTION

Figure 1:
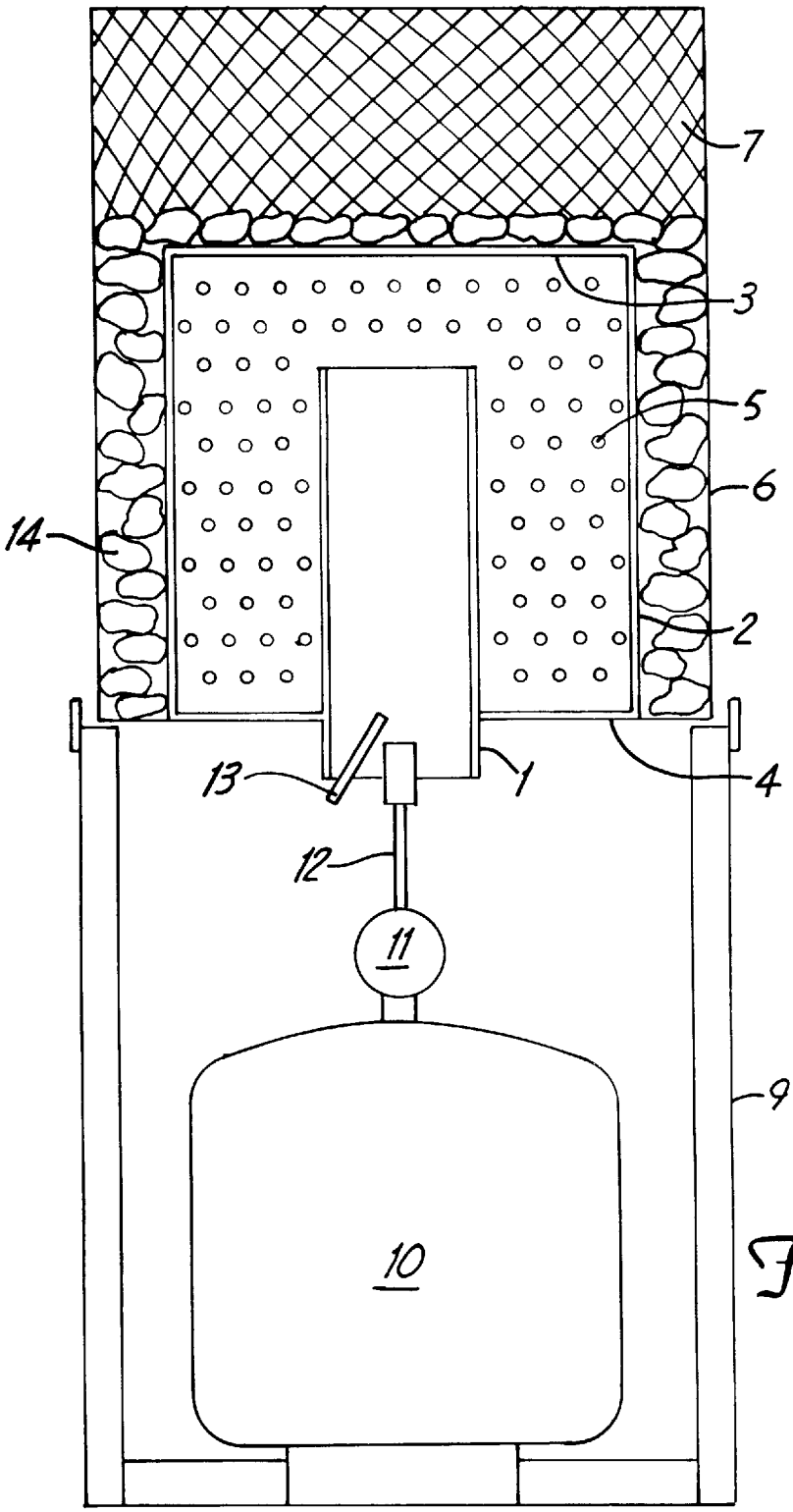
FIG. 1 is a side view in section of a heater in accordance with the invention.

As will be seen from FIG. 1, the illustrated heater comprises a tubular open-ended combustion chamber 1 positioned generally coaxially within a tubular expansion chamber 2 which is closed at its upper and lower ends respectively by a generally circular plate 3 and a ring shaped plate 4 through which the combustion tube 1 projects. The sides of the chamber 2 are perforated to provide a multiplicity of openings 5. These openings may be circular, rectangular or other suitable shape. The combustion chamber and/or expansion chamber may be produced from a stainless steel.

The combustion chamber and expansion chamber are housed within a cylindrical container 6 whose sides are perforated to provide a multiplicity of openings 7. The upper end of the container 6 may be closed, open or perforated as for the container sides. The sides of the container 6 may be formed from wire or wire mesh.

The assembly of the container, combustion chamber and expansion chamber is supported on a stand including a plurality of legs 9. Positioned between the legs 9 is a cylinder 10 of gaseous fuel, e.g. a liquified gas such as propane. The cylinder is connected via a regulator valve 11 and nozzle 12 to inject gaseous fluid into the open lower end of the combustion tube 1. One or a plurality of nozzles 12 may be provided. A piezo electric igniter 13 is positioned within the annular spacing defined by the lower open end of the tube 1, air for combustion purposes being drawn into the tube 1 through this spacing. A secondary source of air may be provided.

Shielding may be positioned between the cylinder 10 and the assembly of the combustion and expansion chamber.

As will be seen from FIG. 1, an annular space is provided between the opposed side faces of the expansion chamber and the container. This space is filled with lava rocks 14 or other heat retaining medium. Lava rocks may also be supported on the plate 3 positioned above the expansion chamber.

In use, gaseous fuel from the cylinder 10 passes into the combustion tube at a rate consistent with the setting of the regulator valve 11 and is ignited by operation of the igniter 13. The igniter may be operated remotely. The ignited mix of fuel and air passes through the combustion tube and enters the chamber 2 in which it expands and from which heat is dissipated through the openings 5 to heat the lava rocks 14. Burning of the air fuel mix may cease within the chamber 2 or may continue within the annular space between the opposed surfaces of the chamber 2 and container 6 and, possibly, at the surface of the container itself.

The lava rocks quickly become red hot thereby creating the heating and visual effects of a brazier without the disadvantages normally associated therewith.

Figure 2:
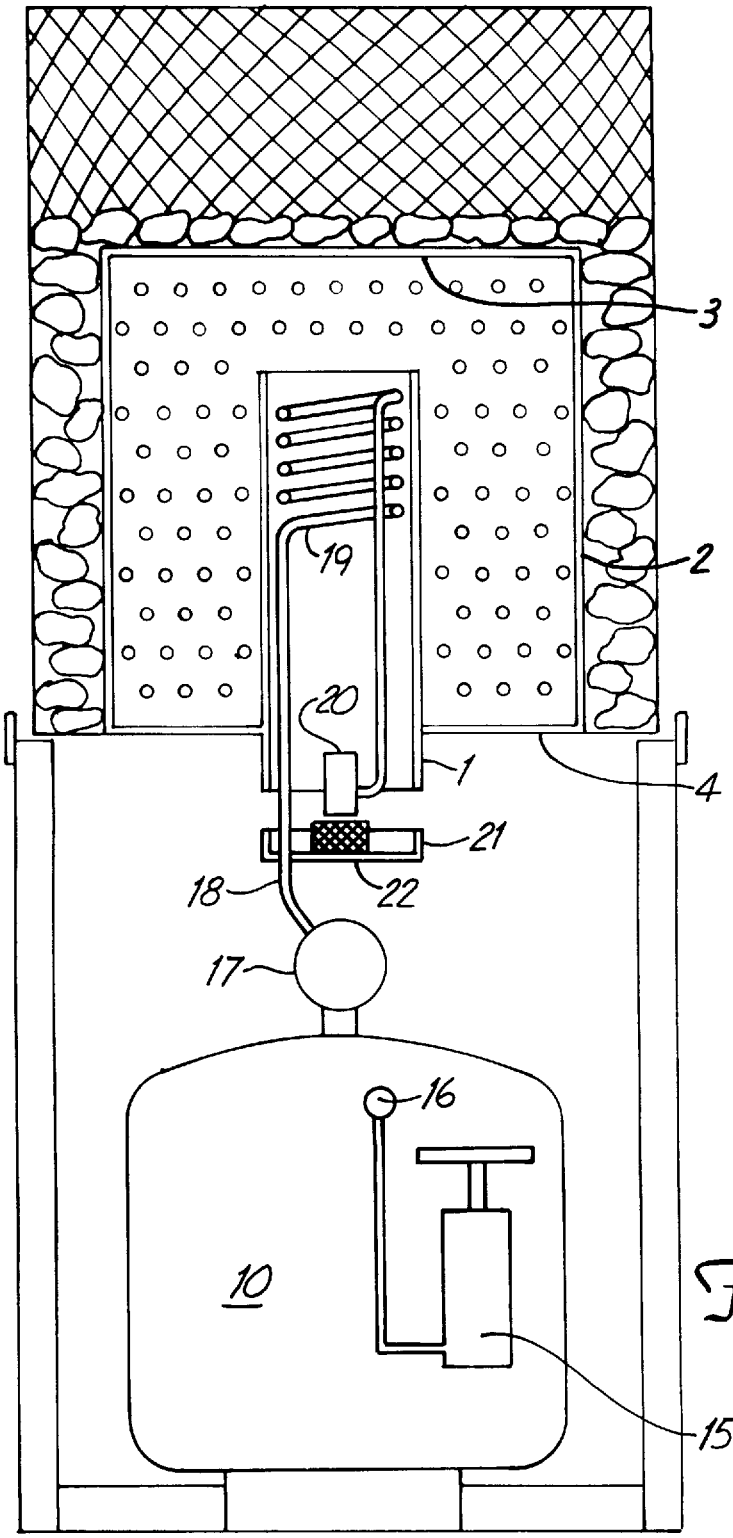
FIG. 2 is a side view in section of an alternative heater utilizing a liquid fuel source in accordance with the invention.

In the arrangement illustrated in FIG. 2, (in which the same reference numerals have been used for the same or similar integers of FIG. 1) a cylinder 10 of liquid fuel, e.g. paraffin, is employed in place of the gas canister of FIG. 1. The cylinder 10 can be pressurised using a hand or foot operated pump 15, the pump being connected to the cylinder through a non-return valve 16. Fuel under pressure is delivered via a tap 17 through a pipe 18 to a vaporising coil 19 and thence to a nozzle 20 through which a jet of fuel is discharged. A shallow container 21 supporting a wick 22 is positioned below the open end of the combustion tube 1.

Figure 3:
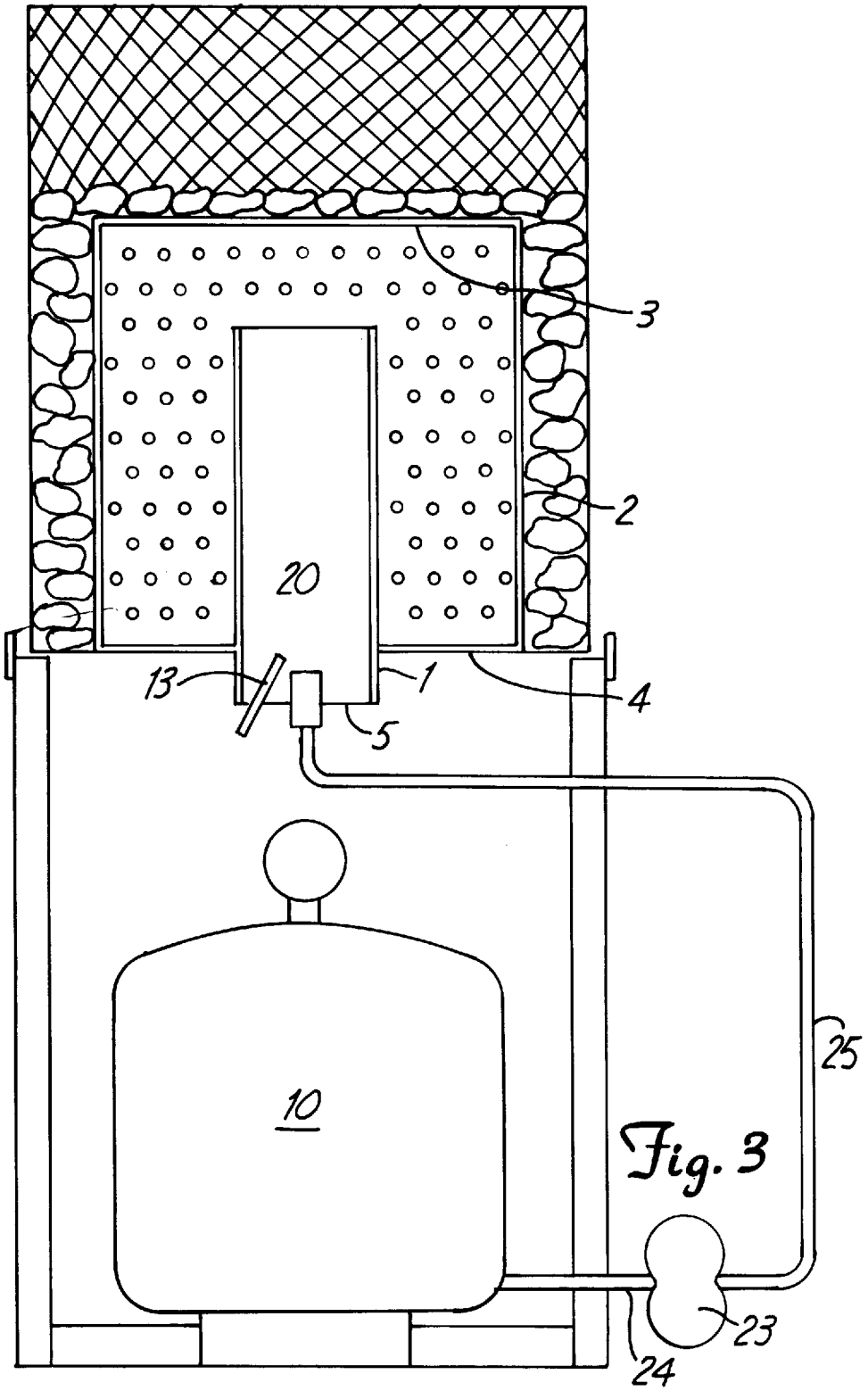
FIG. 3 is a side view in section of an alternative heater utilizing a fuel pump to deliver fuel at high pressure.

In the arrangement illustrated in FIG. 3, a fuel pump 23 is connected to a fuel tank 10 through a pipe 24 to deliver fuel at a high pressure through a pipe 25 to the fuel jet nozzle 20.

The heaters shown in FIGS. 2 and 3 operates effectively in the same way as that described for FIG. 1.

It will be appreciated that the foregoing is merely exemplary of heaters in accordance with the invention and that modifications can readily be made thereto without departing from the true scope of the invention.

Thus a restrictor may be provided within the inlet to the combustion tube to enhance combustion efficiency. Also, the combustion tube may be positioned remote from the expansion chamber, the one simply being in communication with the other. The combustion tube may also be positioned outside the confines of the perforated container.

We claim:

1. A heater comprising:

a burner section comprising:

a combustion chamber where at least part of a fuel and air mixture combusts yielding at least partially combusted fuel and air, the combustion chamber having at least first and second open ends;

a fuel inlet positioned adjacent to the first open end of the combustion chamber;

a substantially closed expansion chamber having perforated sides, the expansion chamber housing a substantial portion of the combustion chamber and expanding the at least partially combusted fuel and air exiting the second open end in the combustion chamber without admixture;

a perforated casing housing the burner section; and a non-combustible layer disposed between the burner section and the perforated casing, such that the non-combustible layer is heated by contact with the at least partially combusted fuel and air as it exits the expansion chamber and through contact with the burner section.

2. A heater of claim 1 wherein the combustion chamber has a cylindrical side wall defining circular first and second open ends, and a longitudinal axis centrally located with respect to the side wall and the first and second open ends.

3. A heater of claim 2 wherein the expansion chamber has a perforated cylindrical side wall attached to a continuous circular top end and a continuous annular bottom end, and a longitudinal axis centrally located with respect to the side wall and the top and bottom ends.

4. A heater of claim 3 wherein the expansion chamber is disposed coaxially around the expansion chamber.

5. A heater of claim 1 wherein the first open end of the combustion chamber is positioned below the second open end of the combustion chamber.

6. A heater of claim 1 wherein the combustion chamber has a top and a bottom and the fuel inlet is positioned at the bottom of the combustion chamber and delivers fuel toward the top of the combustion chamber.

7. A heater of claim 1 wherein the perforated casing comprises a metal drum having sides formed of metal wire.

8. A heater of claim 1 wherein the non-combustible layer is formed of lava rocks.

9. A heater of claim 1 wherein a pre-heater is disposed upstream of the combustion chamber for preheating fuel before it is delivered into the combustion chamber for burning.

10. A heater of claim 1 wherein the expansion chamber is formed from steel.

11. A heater of claim 1 wherein the combustion chamber is formed from steel.

12. A heater of claim 1 wherein the first open is substantially larger than the fuel inlet.

13. A heater of claim 1 wherein an ignitor is positioned adjacent to the fuel inlet.

14. A heater comprising:

a burner section comprising:

a combustion chamber where at least part of a fuel and air mixture combusts yielding at least partially combusted fuel and air, the combustion chamber having at least first and second open ends;

a fuel inlet positioned adjacent to the first open end of the combustion chamber;

a substantially closed expansion chamber having perforated sides, a continuous top and a continuous bottom, the expansion chamber housing a substantial portion of the combustion chamber and expanding the at least partially combusted fuel and air exiting the second open end in the combustion chamber without admixture;

a perforated casing housing the burner section; and a non-combustible layer disposed between the burner section and the perforated casing, such that the non-combustible layer is heated by contact with the at least partially combusted fuel and air as it exits the expansion chamber and through contact with the burner section.

15. A heater comprising:

a burner section comprising:

a combustion chamber where at least part of a fuel and air mixture combusts yielding at least partially combusted fuel and air, the combustion chamber having a continuous perforated cylindrical side wall defining first and second circular open ends and a centrally located longitudinal axis;

a fuel inlet positioned adjacent to the first circular open end of the combustion chamber, the fuel inlet being substantially smaller than the first circular open end;

a substantially closed expansion chamber having a perforated cylindrical side wall attached to a continuous circular top and a continuous annular bottom, the cylindrical side wall defining a longitudinal axis, the expansion chamber disposed coaxially around the combustion chamber to substantially house the combustion chamber, the combustion chamber being positioned within the annular bottom, the expansion chamber expanding the at least partially combusted fuel and air exiting the second circular open end in the combustion chamber without admixture;

a cylindrical perforated casing housing the burner section; and a non-combustible layer disposed between the burner section and the perforated casing, such that the non-combustible layer is heated by contact with the at least partially combusted fuel and air as it exits the expansion chamber and through contact with the burner section.

* * * * *